US007318545B1

(12) United States Patent
Lee

(10) Patent No.: US 7,318,545 B1
(45) Date of Patent: Jan. 15, 2008

(54) STAPLER WITH A STAPLE-SUPPORTING DEVICE

(76) Inventor: Chung-Heng Lee, No. 76, Pao-Kao Rd., Hsintien City, Taipei Hsien (TW)

( * ) Notice: Subject to any disclaimer, the term of this patent is extended or adjusted under 35 U.S.C. 154(b) by 0 days.

(21) Appl. No.: 11/484,673

(22) Filed: Jul. 12, 2006

(51) Int. Cl.
*B25C 5/02* (2006.01)

(52) U.S. Cl. ..... 227/134; 227/119; 227/120

(58) Field of Classification Search ..... 227/119, 227/120, 134, 83, 88, 132
See application file for complete search history.

(56) References Cited

U.S. PATENT DOCUMENTS 2,227,826 A * 1/1941 Drypolcher et al. ..... 227/125
4,187,971 A * 2/1980 Prew, Jr. ..... 227/125
4,542,844 A * 9/1985 Olesen et al. ..... 227/7
5,038,992 A * 8/1991 Shiang et al. ..... 227/120
5,322,189 A * 6/1994 Oda ..... 221/227
5,421,502 A * 6/1995 Huang ..... 227/134
5,560,529 A * 10/1996 Udagawa et al. ..... 227/136
6,142,355 A * 11/2000 Wu ..... 227/134
6,494,356 B1 * 12/2002 Pfründer et al. ..... 227/127
6,808,101 B2 * 10/2004 Laubach et al. ..... 227/109
6,840,422 B2 * 1/2005 Mintzer ..... 227/109
6,918,525 B2 * 7/2005 Marks ..... 227/120

* cited by examiner

*Primary Examiner*—Scott A. Smith
(74) *Attorney, Agent, or Firm*—Bacon & Thomas, PLLC

(57) ABSTRACT

A stapler with a staple-supporting device has a base, a cover, a holding bracket and a pushing device. The base, the cover and the holding bracket are mounted pivotally together. The cover has a staple spade and the holding bracket has a corresponding staple outlet. The pushing device is mounted slidably in the holding device and has a pivoting staple-supporting device. A series of staple is mounted in the holding bracket, and the last staple is mounted on the staple-supporting device. When only one staple is left in the holding bracket, the staple-supporting device keeps the staple from falling out of the staple outlet.

12 Claims, 6 Drawing Sheets

STAPLER WITH A STAPLE-SUPPORTING DEVICE

BACKGROUND OF THE INVENTION

1. Field of the Invention

The present invention relates to a stapler, especially to a stapler that has a staple-supporting device.

2. Description of the Prior Arts

Staplers and staples are generally used to bind a stack of paper and the like. A conventional stapler comprises a base, a holding bracket and a cover. The base, the holding bracket and the cover respectively have a proximal end and a distal end. The proximal ends of the base, the holding bracket and the cover are mounted pivotally together by a pin. The holding bracket is mounted between the base and the cover. The holding bracket has an opening side, a staple outlet, a pushing device and a spring. The staple outlet is formed adjacent to the distal end of the holding bracket. The pushing device is mounted slidably between the proximal and distal ends of the holding bracket. The spring is mounted securely between the pushing device and the proximal end of the holding bracket. The cover has a distal end and a staple spade. The staple spade is formed on the distal end of the cover and corresponds to the staple outlet in the holding bracket. The staples are mounted slidably between the staple outlet and the pushing device in the holding bracket. The spring presses the pushing device toward the distal end of the holding bracket, so the staples are pushed toward the distal end of the holding bracket. The cover is pressed downward so that the staple spade presses the front staple out of the staple outlet to penetrate through the paper.

When only one staple is left in the holding bracket, the pushing device presses the staple against the distal end of the holding bracket to correspond to the staple outlet and holds the staple in holding bracket until the staple spade presses the staple out of the staple outlet. However, the staple may be a larger size so a pattern on the staple decorates the paper. The larger staple has a greater weight. Consequently, the pushing device and the spring may not press the larger staple hard enough against the distal end of the holding bracket to keep the last staple from falling out of the staple outlet before the staple spade presses the last staple. Therefore, the last staple is easy wasted.

To overcome the shortcomings, the present invention provides a stapler with a staple-supporting device to mitigate or obviate the aforementioned problems.

SUMMARY OF THE INVENTION

The main objective of the present invention is to provide a stapler with a staple-supporting device. The stapler with a staple-supporting device has a base, a cover, a holding bracket and a pushing device. The base, the cover and the holding bracket are mounted pivotally together. The cover has a staple spade, and the holding bracket has a corresponding staple outlet. The pushing device is mounted slidably in the holding device and has a pivoting staple-supporting device. A series of staples is mounted in the holding bracket, and the last staple is mounted on the staple-supporting device. When only one staple is left in the holding bracket, the staple-supporting device keeps the staple from falling out of the staple outlet.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
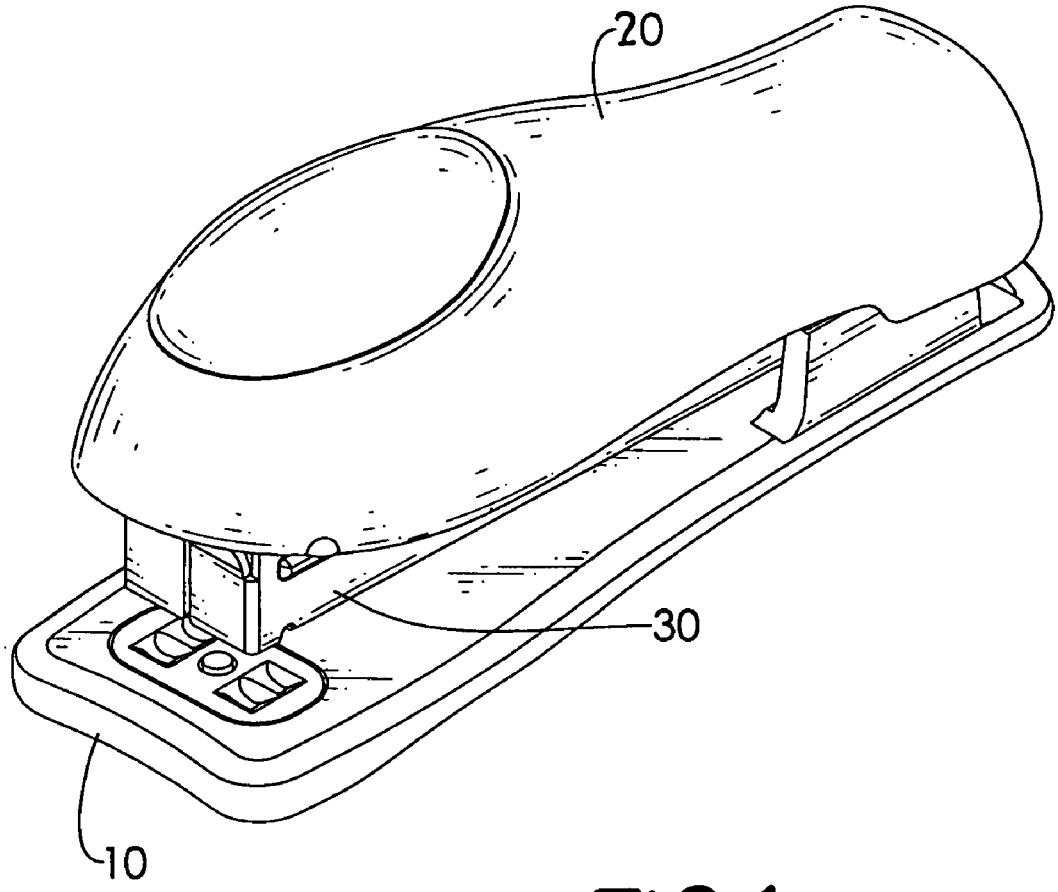
FIG. 1 is a perspective view of a stapler with a staple-supporting device in accordance with the present invention.
Figure 2:
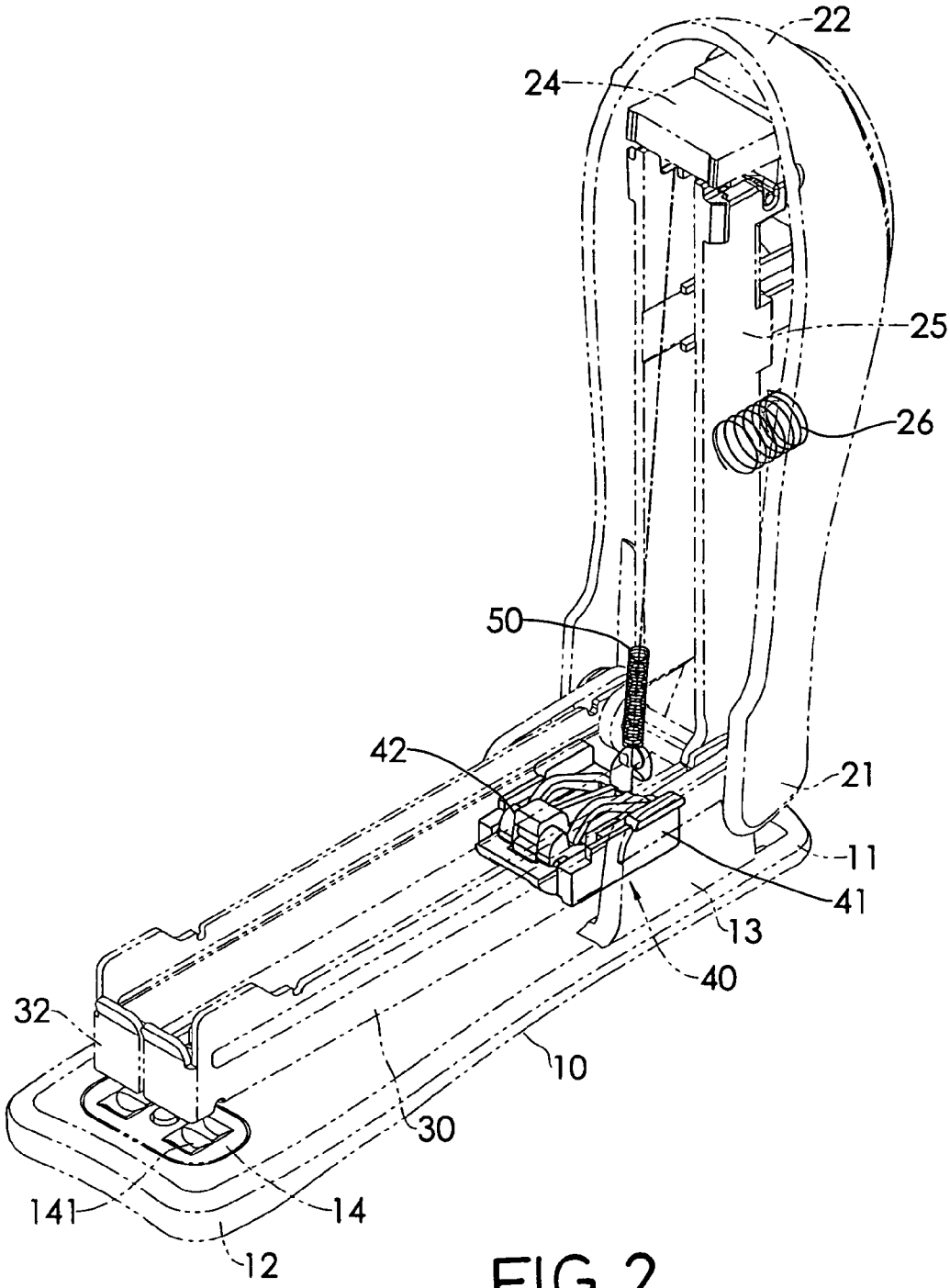
FIG. 2 is an operational perspective view of the stapler in FIG. 1.

With reference to FIGS. 1 and 2, a stapler with a staple-supporting device in accordance with the present invention comprises a base (10), a cover (20), a holding bracket (30), a pushing device (40) and a biasing member (50).

Figure 3:
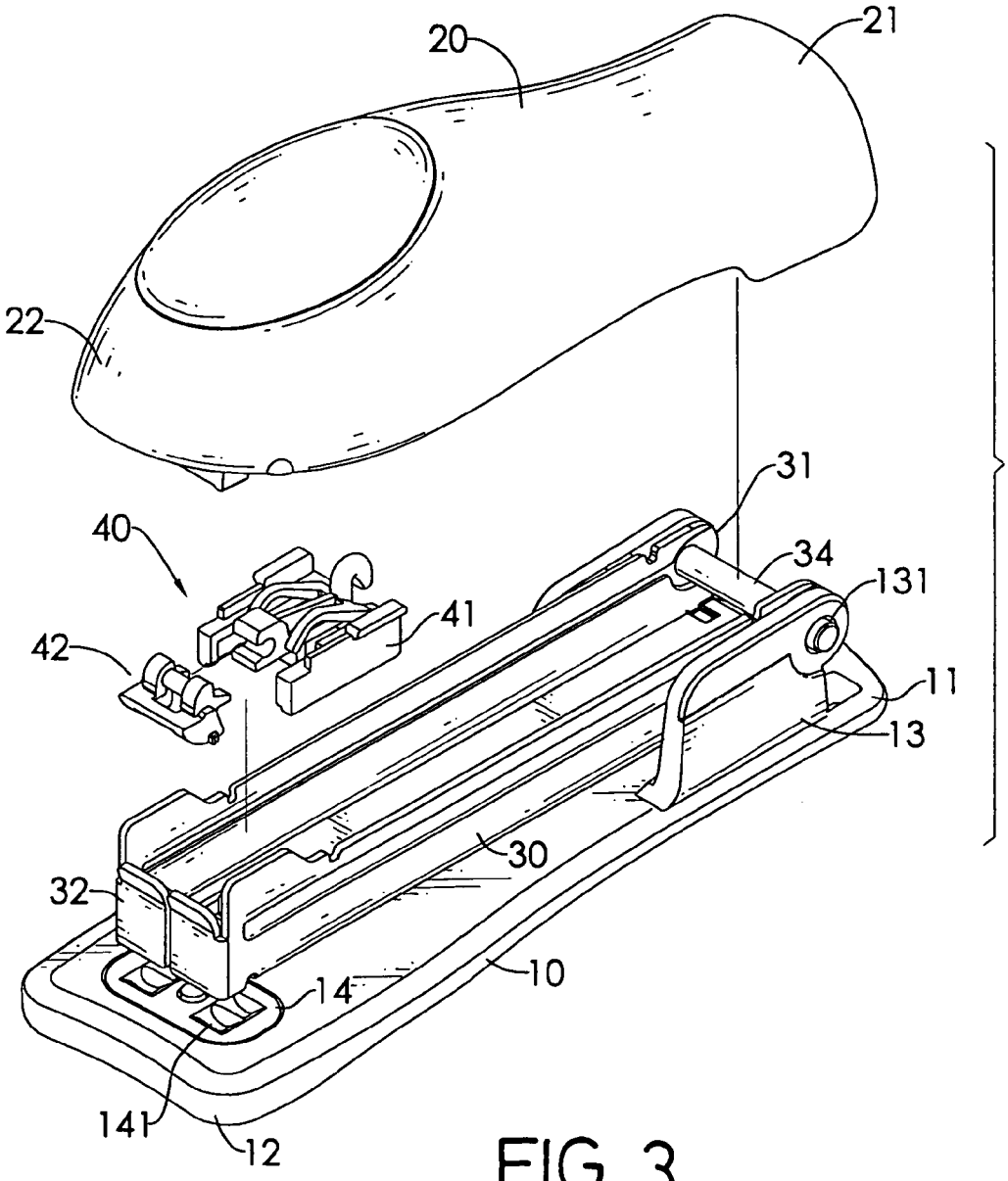
FIG. 3 is a partially exploded perspective view of the stapler in FIG. 1.

With further reference to FIG. 3. the base (10) has a top surface, a pivoting end (11) and a distal end (12) and may have a pivot bracket (13) and a bending foot (14). The pivot bracket (13) is formed on and protrudes up from the top surface of the base (10) at the pivoting end (11) and has a pair of pivot holes (131) formed through the pivot bracket (13). The bending foot (14) causes staples pressed into the bending foot (14) to bend in a desired direction, is mounted in the top surface of the base (10) near the distal end (12) and has at least one pair of recesses (141) formed in the bending foot (14).

The cover (20) is mounted pivotally on the base (10), has an open bottom, a pivoting end (21), a distal end (22) and a staple spade (24) and may have a middle bracket (25) and a spring (26). The open bottom of the cover (20) faces the top surface of the base (10). The pivoting end (21) of the cover (20) is attached pivotally to the pivoting end (11) of the base (10) and may be mounted pivotally in the pivot bracket (13) of the base (10). The staple spade (24) is mounted in the open bottom of the cover (20) adjacent to the distal end (22) and corresponds to the bending foot (14) in the base (10). The middle bracket (25) is mounted securely in the open bottom of the cover (20) and is mounted pivotally on the base (10). The spring (26) is attached to the middle bracket (25) to push the cover (20) upward.

Figure 5:
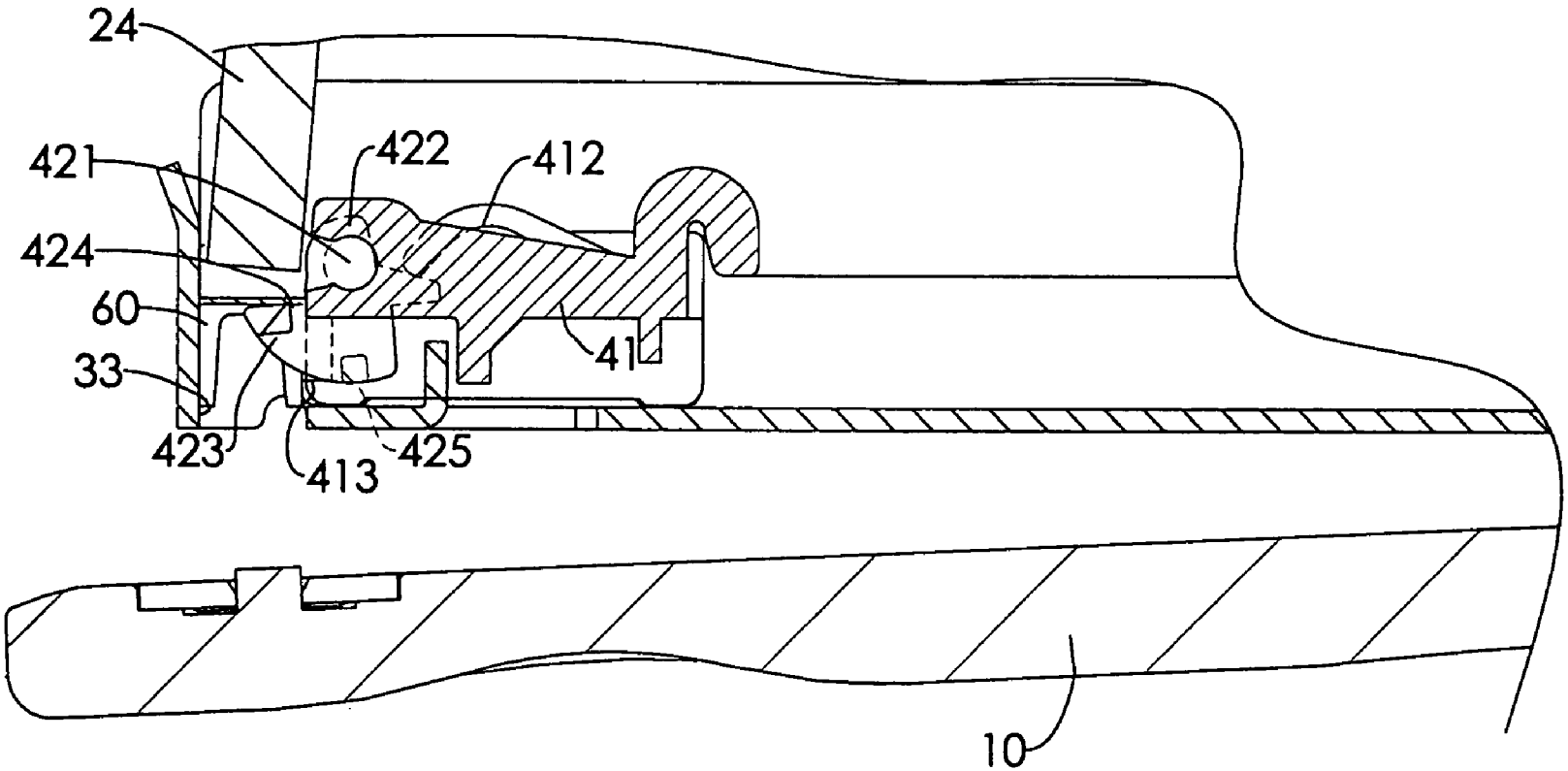
FIG. 5 is an enlarged side view in partial section of the front of the stapler in FIG. 1 with a staple.

With further reference to FIG. 5, the holding bracket (30) is mounted pivotally between the base (10) and the cover (20), may be mounted pivotally in the pivot bracket (13), has an open top, a bottom, a pivoting end (31), a distal end (32) and a staple outlet (33) and may have a pin (34). The open top of the holding bracket (30) faces the open bottom of the cover (20). The pivoting end (31) of the holding bracket (20) is mounted pivotally on the pivoting end (11) of the base (10) and may be mounted pivotally on the pivot bracket (13) of the base (10). The staple outlet (33) is formed through the bottom of the holding bracket (30) at the distal end (32) and corresponds to the staple spade (24) in the cover (20). The pin (34) extends through the pivot holes (131) in the pivot bracket (13) of the base (10) and the pivoting ends (21, 31) of the cover (20) and the holding bracket (30) to pivotally connect the base (10), the cover (20) and the holding bracket (30).

Figure 4:
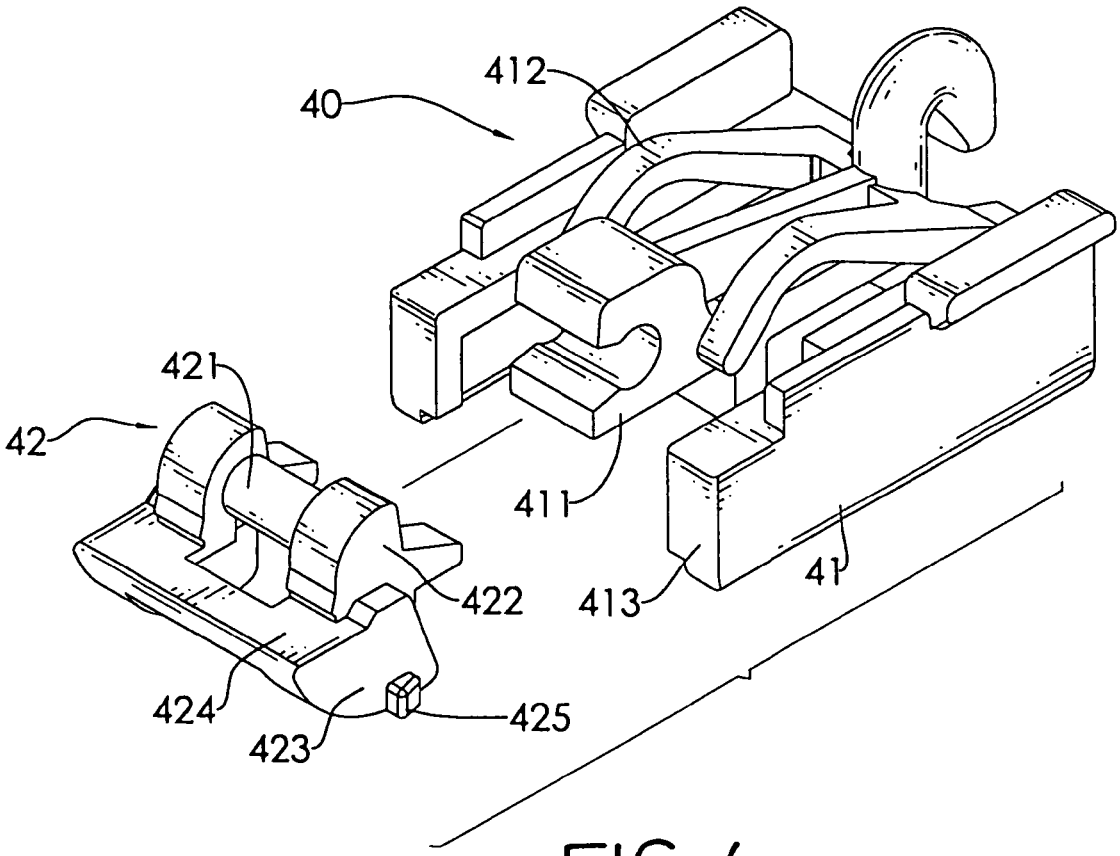
FIG. 4 is an enlarged exploded perspective view of a staple-supporting device in the stapler in FIG. 1.

With further reference to FIG. 4, the pushing device (40) is mounted slidably in the holding bracket (30) and has a body (41) and a staple-supporting device (42).

The body (41) is mounted slidably in the holding bracket (30) and has two sides, a front end, a rear end, an optional clamp (411), at least one resilient arm (412) and two optional flanges (413). The clamp (411) is formed on the front end of the body (41). The at least one resilient arm (412) is formed on and extend from the rear end of the body (41) and may be two resilient arms (412). The two resilient arms (412) are formed respectively at the two sides of the body (41). The flanges (413) are formed respectively on and extend down from sides of the body (41) at the front end.

Figure 6:
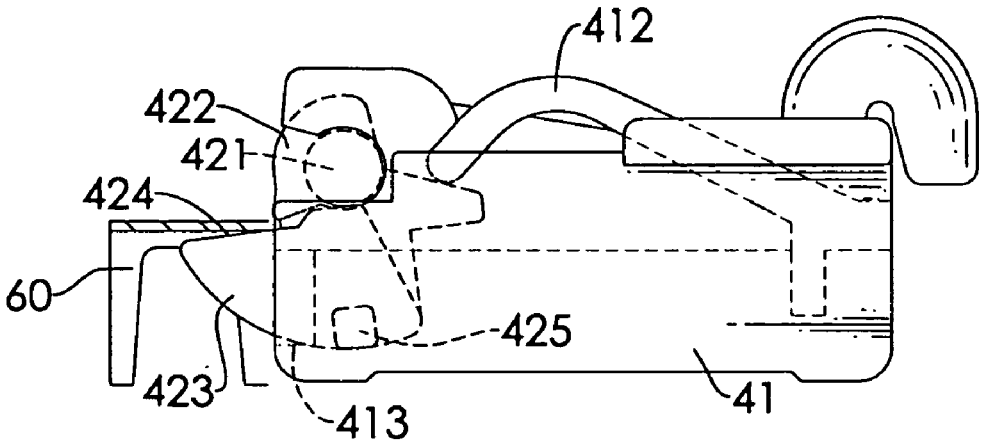
FIG. 6 is an enlarged side view of the staple-supporting device of the stapler in FIG. 1 with a staple.

The staple-supporting device (42) is attached pivotally to the front end of the body (41) and has a pivot rod (421), at least one head (422), a supporting bracket (423) and two optional stops (425). The pivot rod (421) is attached pivotally to the front end of the body (41), may be mounted pivotally in the clamp (411) and has two ends. The at least one head (422) is L-shaped and eccentric, is formed on the pivot rod (421) and corresponds to the at least one resilient arm (412) of the body (41) to hold the staple-supporting device (42) level. The supporting bracket (423) is formed on and protrudes down from the heads (422), extends out of the front end of the body (41) and has a supporting surface (424) and two ends. With further reference to FIG. 6, the stops (425) are formed respectively on the ends of the supporting bracket (423) and respectively correspond to and selectively abut the flanges (413) of the body (41).

The biasing member (50) is mounted between the pushing device (40) and the cover (20) to push the pushing device (40) toward the distal end (32) of the holding bracket (30) and has a stationary end and a movable end. The stationary end of the biasing member (50) is attached to the cover (20) near the distal end (22) and may be attached to the middle bracket (25) in the cover (20). The movable end of the biasing member (50) is attached to the rear end of the body (41) of the pushing device (40).

A staple series is mounted in the holding bracket (30) and the last staple (60) is mounted on the supporting surface (424) of the staple-supporting device (42). When only the last staple (60) is left in the holding bracket (30), the pushing device (40) pushes the last staple (60) to align with the staple outlet (33) in the holding bracket (30).

Figure 7:
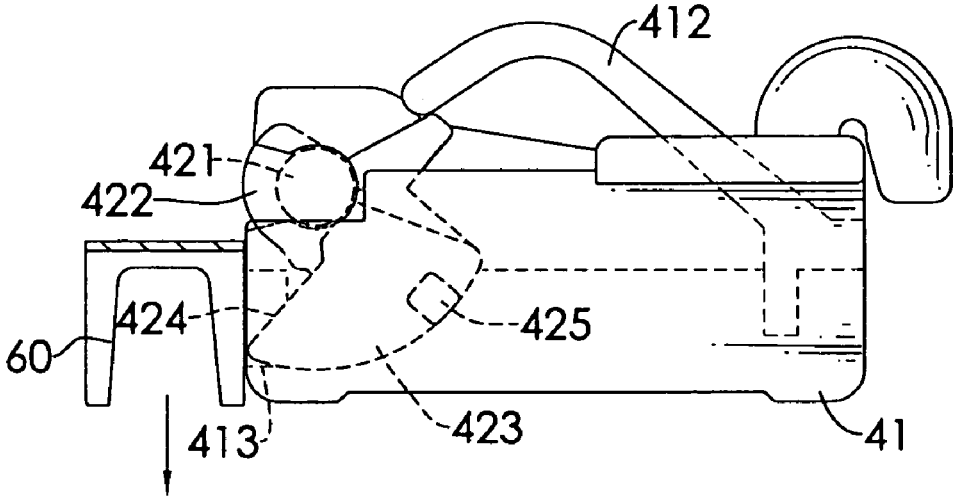
FIG. 7 is an operational enlarged side view of the staple-supporting device of the stapler in FIG. 1.

With further reference to FIG. 7, the cover (20) is pressed downward and the staple spade (24) presses the last staple (60) downward. The staple-supporting device (42) pivots downward and the heads (422) push the resilient arms (412) upward. Then the last staple (60) passes through the staple outlet (33) and penetrates the paper. When the cover (20) moves upward, the resilient arms (412) pivot the heads (421) until the supporting surface (424) is level, and the stops (425) abut the flanges (413) to prevent over pivoting.

Because the last staple (60) is held by the staple-supporting device (42), the last staple (60) will not fall out of the staple outlet (33) before the staple spade (24) presses the last staple (60). Therefore, all staples can be used and will not be wasted.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A stapler with a staple-supporting device comprising:
a base having a top surface, a pivoting end and a distal end;
a cover mounted pivotally on the base and having
an open bottom facing the top surface of the base;
a pivoting end attached pivotally to the pivoting end of the base;
a distal end; and
a staple spade mounted in the open bottom of the cover adjacent to the distal end;
a holding bracket mounted pivotally between the base and the cover and having
an open top facing the open bottom of the cover;
a bottom;
a pivoting end mounted pivotally on the pivoting end of the base;
a distal end; and
a staple outlet formed through the bottom of the holding bracket at the distal end and corresponding to the staple spade in the cover; and
a pushing device mounted slidably in the holding bracket wherein the improvement comprising:
the pushing device having
a body mounted slidably in the holding bracket and having
two sides;
a front end;
a rear end; and
at least one resilient arm formed on and extending from the rear end of the body; and
a staple-supporting device attached pivotally to the front end of the body and having
a pivot rod attached pivotally to the front end of the body and having two ends;
at least one head being eccentric, formed on the pivot rod and corresponding to the at least one resilient arm of the body; and
a supporting bracket formed on and protruding from the at least one head, extending out of the front end of the body and having a supporting surface and two ends.

2. The stapler as claimed in claim 1, wherein
the body of the pushing device further has a clamp formed on the front end of the body; and
the pivot rod of the staple-supporting device is mounted pivotally in the clamp.

3. The stapler as claimed in claim 2, wherein
the body of the pushing device further has two flanges formed respectively on the sides of the body; and
the staple-supporting device further has two stops formed respectively on the ends of the supporting bracket and respectively corresponding to and selectively abutting the flanges of the body.

4. The stapler as claimed in claim 3, wherein
the cover further has
a middle bracket mounted securely in the open bottom of the cover and mounted pivotally on the base; and
a spring attached to the middle bracket; and
the stationary end of the biasing member is attached to the middle bracket in the cover.

5. The stapler as claimed in claim 4, wherein
the base further has a bending foot formed in the top surface of the base near the distal end and having at leas one pair of recesses formed in the bending foot; and
the staple spade of the cover corresponds to the bending foot in the base.

6. The stapler as claimed in claim 5, wherein the base further has a pivot bracket formed on and protruding from the top surface of the base at the pivoting end and having a pair of pivot holes formed through the pivot bracket;

the pivoting end of the cover is mounted pivotally in the pivot bracket of the base;

the pivoting end of the holding bracket is mounted pivotally in the pivot bracket of the base; and the holding bracket further has a pin extending through the pivot holes in the pivot bracket of the base and the pivoting ends of the cover and the holding bracket to pivotally connect the base, the cover and the holding bracket.

7. The stapler as claimed in claim 6, wherein the body has two resilient arms formed respectively at the two sides of the body.

8. The stapler as claimed in claim 5, wherein the body has two resilient arms formed respectively at the two sides of the body.

9. The stapler as claimed in claim 4, wherein the base further has a pivot bracket formed on and protruding from the top surface of the base at the pivoting end and having a pair of pivot holes formed through the pivot bracket;

the pivoting end of the cover is mounted pivotally in the pivot bracket of the base;

the pivoting end of the holding bracket is mounted pivotally in the pivot bracket of the base; and the holding bracket further has a pin extending through the pivot holes in the pivot bracket of the base and the pivoting ends of the cover and the holding bracket to pivotally connect the base, the cover and the holding bracket.

10. The stapler as claimed in claim 1, wherein the cover further has a middle bracket mounted securely in the open bottom of the cover and mounted pivotally on the base; and a spring attached to the middle bracket; and the stationary end of the biasing member is attached to the middle bracket in the cover.

11. The stapler as claimed in claim 1, wherein the base further has a bending foot formed in the top surface of the base near the distal end and having at least one pair of recesses formed in the bending foot; and the staple spade of the cover corresponds to the bending foot in the base.

12. The stapler as claimed in claim 1, wherein the base further has a pivot bracket formed on and protruding from the top surface of the base at the pivoting end and having a pair of pivot holes formed through the pivot bracket;

the pivoting end of the cover is mounted pivotally in the pivot bracket of the base;

the pivoting end of the holding bracket is mounted pivotally in the pivot bracket of the base; and the holding bracket further has a pin extending through the pivot holes in the pivot bracket of the base and the pivoting ends of the cover and the holding bracket to pivotally connect the base, the cover and the holding bracket.

* * * * *